US005249950A

United States Patent [19]

Woolford

[11] Patent Number: 5,249,950

[45] Date of Patent: Oct. 5, 1993

[54] HEATED STRIPPER SHOE ASSEMBLY

[75] Inventor: Michael E. Woolford, Lake Elmo

[73] Assignee: Block Systems Inc., North St. Paul, Minn.

[21] Appl. No.: 828,031

[22] Filed: Jan. 30, 1992

[51] Int. Cl.[5] ..... B28B 13/06

[52] U.S. Cl. ..... 425/412; 100/218; 425/413; 425/422; 425/443; 425/444

[58] Field of Search ..... 249/66.1, 74, 78, 136; 425/253, 255, 407, 412, 413, 422, 436 R, 443, 444, 452, DIG. 13; 100/218, 93 R, 93 P

[56] References Cited

U.S. PATENT DOCUMENTS

| | | | |
|---|---|---|---|
| D. 280,024 | 8/1985 | Risi et al. | D25/80 |
| D. 296,365 | 6/1988 | Forsberg | D25/116 |
| D. 299,067 | 12/1988 | Forsberg | D25/58 |
| D. 299,069 | 12/1988 | Risi et al. | D25/157 |
| 566,924 | 9/1896 | Morrin | 110/308 |
| 1,219,127 | 3/1917 | Marshall | 249/101 |
| 1,287,055 | 12/1918 | Lehman | 249/123 |
| 1,414,444 | 5/1922 | Straight | 52/437 |
| 1,419,805 | 6/1922 | Bigler | 52/311 |
| 1,465,608 | 8/1923 | McCoy | 249/104 |
| 1,557,946 | 10/1925 | Smith | 249/144 |
| 1,733,790 | 10/1929 | Gilman | 405/273 |
| 1,907,053 | 5/1933 | Flath | 405/273 |
| 2,121,450 | 6/1938 | Sentrop | 249/64 |
| 2,313,363 | 3/1943 | Schmitt | 405/286 |
| 2,371,201 | 3/1945 | Wells | 52/505 |
| 2,570,384 | 10/1951 | Russell | 249/85 |
| 2,963,828 | 12/1960 | Belliveau | 52/564 |
| 3,204,316 | 9/1965 | Jackson | 249/13 |
| 3,378,885 | 4/1968 | Dart | 425/407 |
| 3,390,502 | 7/1968 | Carroll | 52/424 |
| 3,754,499 | 8/1973 | Heisman et al. | 425/407 |
| 3,932,098 | 1/1976 | Huber et al. | 425/422 |
| 3,995,434 | 12/1976 | Kato et al. | 405/33 |
| 4,023,767 | 5/1977 | Fontana | 249/52 |
| 4,107,894 | 8/1978 | Millins | 52/593 |
| 4,110,949 | 9/1978 | Cambiuzzi et al. | 52/437 |
| 4,124,961 | 11/2978 | Habegger | 52/592 |
| 4,132,492 | 1/1979 | Jenkins | 404/119 |
| 4,187,069 | 2/1980 | Mullins | 425/470 |
| 4,207,718 | 6/1980 | Schaaf et al. | 52/585 |
| 4,214,655 | 7/1980 | Bernham et al. | 198/374 |
| 4,218,206 | 8/1980 | Mullins | 425/253 |
| 4,228,628 | 10/1980 | Schlomann | 52/438 |
| 4,229,123 | 10/1980 | Heinzmann | 405/273 |
| 4,314,431 | 2/1982 | Rabassa | 52/259 |
| 4,335,549 | 6/1982 | Dean | 52/98 |
| 4,426,815 | 1/1984 | Brown | 52/100 |
| 4,490,075 | 12/1984 | Risi et al. | 405/273 |
| 4,496,266 | 1/1985 | Ruckstuhl | 404/41 |
| 4,524,551 | 6/1985 | Scheiwiller | 52/98 |
| 4,640,071 | 2/1987 | Haener | 52/286 |
| 4,802,320 | 2/1989 | Forsberg | 52/585 |
| 4,802,836 | 2/1989 | Whissell | 425/253 |
| 4,909,717 | 3/1990 | Pardo | 425/138 |
| 5,062,610 | 11/1991 | Woolford et al. | 249/52 |
| 5,158,132 | 10/1992 | Guillemot | 425/407 |

FOREIGN PATENT DOCUMENTS

| | | |
|---|---|---|
| 1188116 | 6/1985 | Canada . |
| 1811932 | 6/1978 | Fed. Rep. of Germany . |
| 2755833 | 7/1988 | Fed. Rep. of Germany . |
| 1385207 | 2/1975 | United Kingdom . |
| 2213095 | 8/1989 | United Kingdom . |

OTHER PUBLICATIONS

Handy Stone Retaining Wall System Literature, 1989.
Standard Load-Bearing Wall Tile Literature, 1924.
Aztech Wall System Technical Specification, 1989.
Vulcan Cartridge Heater Specification, W. W. Granger Catalog (no date).
Steel ASTM Ratings, 1977.
Diamond Wall System, Design Manual, 1989.
Anchor Autoclave Product Literature, 1990.

*Primary Examiner*—Tim Heitbrink
*Assistant Examiner*—James P. Mackey
*Attorney, Agent, or Firm*—Merchant, Gould, Smith, Edell, Welter & Schmidt

[57] ABSTRACT

The invention is a heated stripper shoe assembly for use in manufacture of concrete masonry blocks. The heated stripper shoe has a stripper shoe plate, at least one heat blocks and at least one heat element fitted within the heat block. Optionally, the stripper shoe assembly may also include a heat shroud positioned over the heat block on the upper surface of the stripper shoe plate, a standoff attached to the heat shroud for affixing the assembly to a block machine, and a mold for use with the stripper shoe assembly. The invention also includes methods of using the assembly.

18 Claims, 3 Drawing Sheets

HEATED STRIPPER SHOE ASSEMBLY

FIELD OF THE INVENTION

The invention relates generally to stripper shoe/mold assemblies for the manufacture of concrete masonry blocks. More specifically, the invention relates to heated stripper shoe/mold assemblies for the molding of concrete blocks having edges or other detail or ornamentation of varying size.

BACKGROUND OF THE INVENTION

Various devices have been developed for the automatic manufacture of concrete masonry blocks. For example, Bernham et al, U.S. Pat. No. 4,214,655, disclose a machine for the automated casting, curing, moving and stacking of concrete blocks. Jenkins, U.S. Pat. No. 4,132,492, discloses a self-propelled concrete screed machine having a winch and cable propulsion system.

Whissell, U.S. Pat. No. 4,802,836, discloses a compaction device for concrete block molding. Pardo, U.S. Pat. No. 4,909,717 and counterpart UK Patent Application No. 2,213,095A, discloses a concrete masonry casting apparatus incorporating reciprocal actuating plungers which cause a shape modification of blocks during casting.

However, automated block molding processes often cannot provide blocks of varying size with a high level of detail or ornamentation having the required structural integrity. For example, wet concrete fill used in the manufacture of blocks often transfers moisture to the stripper shoe during the process of compaction. Once wet, the stripper shoe becomes sticky due to the moisture present at its surface. As a consequence, fill material may stick to the stripper shoe.

The shoe may become fouled with mix, especially in indented areas used to form ornamentation, design, or detail on the blocks. In turn, various intended features of the block may be malformed or completely omitted as indentations or patterning on the stripper shoe are clogged or fouled with concrete mix. Ultimately this results in block features which are malformed and further eroded during curing and use. This problem fails to lend itself to the efficient manufacture of blocks having the required structural integrity and the intended level of detail or ornamentation.

However, in overcoming the problem of stripper shoe fouling, several requirements of automated manufacture must be satisfied. The elements of the block molding machine must withstand automated block molding processes which often involve a high degree of vibration, dirt, and compression, among other environmental stresses. Electrical elements are often not capable of surviving over a long term period under these conditions. Further, head assemblies must be serviceable to provide for operator safety as well as easy disassembly.

As a result, a need exists for a non-fouling stripper shoe and stripper shoe/mold assembly allowing for the formation of concrete masonry blocks of a high level of detail which at the same time provides for easy serviceability, operator safety, and longevity in an environment of high manufacturing stress.

SUMMARY OF THE INVENTION

In accordance with the invention there is provided a heated stripper shoe comprising a stripper shoe plate, and at least one removable heat element positioned within the heat block.

In accordance with another aspect of the invention there is provided a heated stripper shoe and mold assembly for the manufacture of composite masonry blocks comprising a stripper shoe plate, a heat block positioned on the heated stripper shoe, a heat element inserted within the heat block, a heat shroud positioned over the heat block, means for attaching the heated stripper shoe to the block machine head, and a mold.

In accordance with a further aspect of the invention there is provided a method of using the shoe and mold assembly disclosed herein.

I have found that by applying heat, through the stripper shoe, to the concrete fill adjacent the desired feature or the point of detail or ornamentation, the fill dries and hardens quickly. The fill does not adhere to and foul the stripper shoe lower surface. Heat transmitted from the heat elements through the shoe contacts the fill during compression and evaporates excess water from the surface of the fill. Heat prevents moisture from forming on the lower surface of the shoe and, in turn, dissipates any opportunity for an adhesive effect between the shoe and each subsequent batch of fill or mix.

The invention allows for molding blocks of all sizes, having high levels of detail, without fouling the stripper shoe or malforming the block or block feature. Through use of the invention, blocks having features of minimal size can be formed with high precision and structural integrity.

In its preferred mode the invention incorporates a stripper shoe which has a heat element, detachably mounted to the shoe upper side, adjacent the indentation in the shoe lower side. The design of the invention withstands environmental stresses such as vibration, dirt, and compression and offers a system which is easily disassembled for repair or modification without risk to the operation.

DETAILED DESCRIPTION OF THE PREFERRED EMBODIMENTS

The invention comprises a heated stripper shoe, a heated stripper shoe/mold assembly and a method of forming concrete masonry blocks with the shoe and mold assembly.

THE STRIPPER SHOE/MOLD ASSEMBLY

Figure 1:
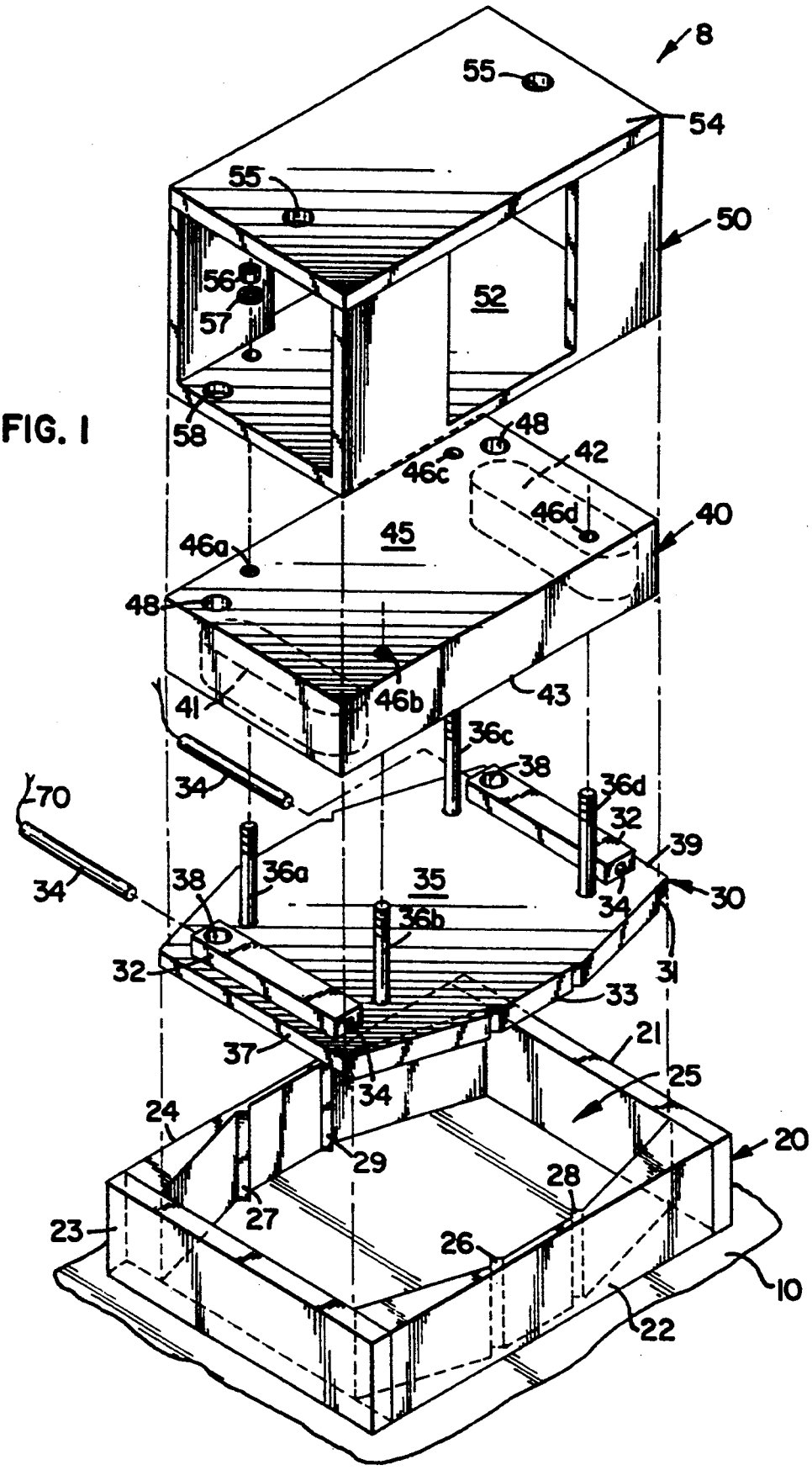
FIG. 1 is an exploded perspective view of the heated stripper shoe/mold assembly in accordance with one embodiment of the claimed invention.

Turning to the Figures wherein like parts are designated with like numerals throughout the several views, FIG. 1 shows a stripper shoe and mold assembly 8. The stripper shoe and mold assembly generally includes a stripper shoe plate 30, having a lower side 33 and an upper side 35. The stripper shoe plate 30 may have indentations to form block edges or details such as those shown at 31 on the shoe lower side 33, see also FIG. 2. Heat blocks 32 may be positioned on the stripper shoe plate upper side 35. Heat elements 34 may be positioned or inserted within the heat blocks 32.

Positioned over the heat blocks 32 on the upper surface of the shoe plate is a heat shroud 40. The heat shroud 40 has a lower side 43 and an upper side 45. The heat shroud lower side 43 has indentations 42 positioned to cover the heat blocks 32 once the heat shroud 40 is positioned over the upper surface 35 of the stripper shoe plate 30, (see also FIG. 4).

Also shown in FIG. 1 is the standoff 50 which attaches the stripper shoe assembly 8 to the block machine head (not shown). The standoff 50 is capable of spacing the stripper shoe plate 30 appropriately in the block machine and insulating the head from the heat developed at the surface of the stripper shoe plate 30.

The assembly also comprises a mold 20 having an interior perimeter designed to complement the outer perimeter of the stripper shoe plate 30. The mold generally has an open center 25 bordered by the mold walls. In fact, the mold may take any number of forms or embodiments such as those depicted in U.S. Pat. No. 5,062,610, incorporated herein by reference Positioned beneath the mold is a pallet 10 used to contain the concrete fill in the mold and transport finished blocks from the molding machine. The stripper shoe assembly 8 may be seen in FIG. 2 in its assembled form.

The stripper shoe 30 serves as a substrate on which the heat elements 34 and heat blocks 32 are contained. Further, the stripper shoe plate 30 also functions to form the body of the block as well as detail in the blocks through indentations in the stripper shoe lower surface 33, see FIG. 4. In use, the stripper shoe 30 functions to compress fill positioned in the mold and, once formed, push or strip the block from the mold 20.

The stripper shoe plate 30 may take any number of designs or forms including ornamentation or structural features consistent with the block to be formed within the mold. Any number of steel alloys may be used in fabrication of the stripper shoe as long as these steel alloys have sufficient resilience and hardness to resist abrasives often used in concrete fill. Preferably, the stripper shoe 30 is made from steel alloys which will resist continued compression and maintain machine tolerances while also transmitting heat from the heat elements through the plate 30 to the fill. In this manner, the total thermal effect of the heat elements is realized within the concrete mix.

Preferably, the stripper shoe plate 30 is made from a carbonized steel which may further be heat treated after forging. Preferred metals include steel alloys having a Rockwell "C"-Scale rating from about 60–65 which provide optimal wear resistance and the preferred rigidity. Generally, metals also found useful include high grade carbon steel of 41-40 AISI (high nickel content, prehardened steel), carbon steel 40-50 (having added nickel) and the like. A preferred material includes carbon steel having a structural ASTM of A36. Preferred steels also include A513 or A500 tubing, ASTM 42-40 (prehardened on a Rockwell C Scale to 20 thousandths of an inch). The stripper shoe plate may be formed and attached to the head assembly by any number of processes known to those of skill in the art including the nut, (36A–36D), washer (57), and bolt 56A–56D mechanism shown in FIG. 1.

One preferred heated stripper shoe design which complements a two block mold is shown in FIG. 1. Sides 37 and 39 of the stripper shoe have an indentation 31 on the shoe lower side 33. A heat block 32 is positioned over both indentations 31. The outer perimeter of the stripper shoe 30 may generally complement the interior outline of the mold 20. Heat blocks 32 are preferably positioned adjacent to each indentation 31 on the shoe lower side 33 to facilitate the formation of that point of detail created by the indentation 31 in the stripper shoe 30. While generally shown with one form of indentation 31, the stripper shoe plate 30 may be capable of forming any number of designs through indentations in the shoe plate lower surface 33 depending on the nature of the block to be formed.

The invention may also comprise one or more heat elements 34, FIG. 1. Generally, the heat element 34 functions to generate and transmit radiant energy to the upper surface 35 of the stripper shoe 30. The heat elements are preferably positioned adjacent indentation 31 in the shoe plate lower surface 33.

Generally, any number of heat elements 34 may be used in accordance with the invention. However, preferred heat elements have been found to be those which will withstand the heavy vibration, dirt and dust common in this environment. Preferred heat elements are those which are easily introduced and removed from the system. This allows for easy servicing of the stripper shoe assembly without concerns for injury to the operator through thermal exposure or complete disassembly of mold 20, stripper shoe 30, shroud 40, and standoff 50.

The heat element may comprise any number of electrical resistance elements which may be, for example, hard wired, solid state, or semiconductor circuitry, among others. One system found preferable, (FIGS. 1 and 3), is a cylindrical heat element 34 inserted into fastening means such as heat block 32. This heat element 34 is easily introduced into the heat block 32 and held in the heat block by any number of means such as a screw, bolt, or bracket inserted through opening 38.

Figure 3:
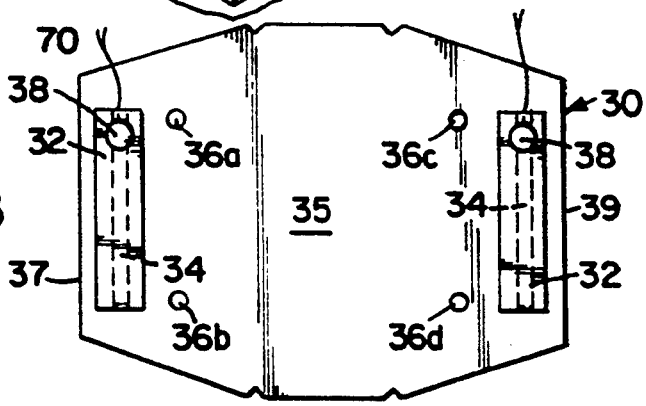
FIG. 3 is a top plan view of the heated stripper shoe depicted in FIG. 1.

In this embodiment of the invention, the heat element 34 may generally run the length of heat block 32 and is positioned parallel to edges 37 and 39 of the stripper shoe 30, FIG. 3. The heat element is also positioned at the stripper shoe upper surface 35 preferably adjacent the indentations 31 formed in the sides 37 and 39 of the stripper shoe 30 at its lower surface 33. By this positioning, the heat element 34 is able to apply heat to the stripper shoe 30 in the area where it is most needed, that is, where the block detail (in this case, flange 62, see FIG. 6) is formed in the concrete mix held by the mold.

The heat element 34 may comprise any number of commercially available elements. Generally, the power provided by the heat element may range anywhere from 300 watts up to that required by the given application. Preferably, the power requirements of the heat element may range from about 400 watts to 1500 watts, more preferably 450 watts to 750 watts, and most preferably about 600 watts. Power may be provided to the heat elements by any number of power sources including for example, 110 volt sources equipped with 20 to 25 amp circuit breakers which allow the assembly to run off of normal residential current. If available, the assembly may also run off of power sources such as 3-phase, 220 volt sources equipped with 50 amp circuit breakers or other power sources known to those of skill in the art. However, the otherwise low power requirements of the assembly allow use in any environment with minimal power supplies.

Elements found useful in the invention include cartridge heaters, available from Vulcan Electric Company, through distributor such as Granger Industrial Co. of Minnesota. These elements have all been found to provide easy assembly and disassembly in the stripper shoe of the invention as well as good tolerance to vibration, dirt, dust, and other stresses encountered in such an environment.

Generally, the heat elements may be activated by hard wiring 70, FIGS. 1 and 3, as well as any other variety of electrical feeds known to those of skill in the art. If hard wiring is used provision may be made to circulate this wiring 70 through the shroud 40 and standoff 50 by various openings 48 and 58, respectively. The heat element 34 may be externally controlled through any number of digital or analogue mechanisms known to those of skill in the art located at an external point on the block machine.

The invention may also comprise means of attaching the heat element 34 to the stripper shoe 30 such as heat block 32, FIG. 1. In a preferred embodiment of the invention, the heat block 32 also contains the heat generated by the heat element 34 from the head assembly and directs that heat energy towards the stripper shoe 30.

In accordance with these functions, the heat block 32 disclosed herein may take any number of shapes or forms and comprise any number of different materials. Preferably, the heat block 32 may be designed to provide a highly serviceable releasable containment area for the heat element 34. The heat block may be positioned on the upper surface 35 of the stripper shoe 30 adjacent any corresponding area of detail on the lower surface 33 of the stripper shoe 30.

Figure 4:
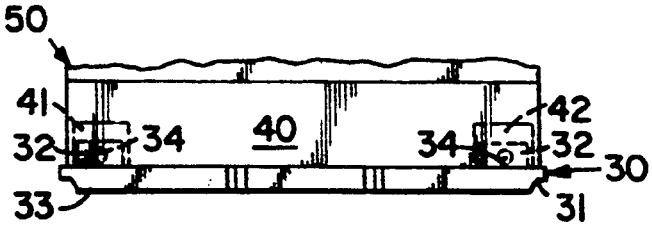
FIG. 4 depicts a partial cross-sectional view of the heated stripper shoe shown in FIG. 2.

In one embodiment of the invention, the heat block 32 preferably takes the shape of a three dimensional rectangle having a square cross section, FIGS. 1, 3 and 4. The heat block 32 may be hollowed or bored out to allow insertion of a heat element 34 into the block 32. The heat block 32 may also have any number of holes or apertures useful in the insertion of screws, bolts, or other means useful holding the heat element 34 within the block 32.

Generally, the heat block 32 may be held on the stripper shoe by any number of means including welding, bolting and the like. As can be seen in FIG. 4, the heat block 32 may have any variety of cross sectional shapes including that of a square or rectangle. Once the heat element 34 is placed into the heat block 32, wiring may be played out from the heat element and inserted through the heat shroud 40 and head standoff 50 to the appropriate connection at the top of the head.

The heat block 32 may comprise any number of materials which allow for the releasable fixing of the block 32 and heat element 34 to the shoe 30. Preferably, the heat block 32 has an open bottom which allows the element 34 to lie flush and in contact with the stripper shoe upper surface 35. This configuration allows free transmission of heat to the upper surface of the stripper shoe while precluding or insulating the head structure from the heat generated by the heat element 34.

Generally, the heat block may comprise any number of metal alloys including ASTM 41-40 carbon steel, and A36 cold roller steel, hot rolled carbon steel. The preferred metal has been found to be A36 cold rolled steel due to its low conduction of heat which thereby further thermally insulates the shroud 40 and standoff 50.

The stripper shoe may also comprise a heat shroud 40, FIG. 1, which thermally shields or insulates the head standoff 50 and molding machine. The heat shroud 40 also functions to focus the heat generated by the heat elements back onto the stripper shoe 30.

The heat shroud 40 may take any number of shapes of varying size in accordance with the invention. The heat shroud 40 should preferably contain the heat elements 34. To this end, the heat shroud 40 preferably has a void 42 formed within its volume so that it may be placed over the heat block 32 positioned on the upper surface 35 of the stripper shoe 30. At the same time, the shroud 40 is preferably positioned flush with the stripper shoe upper surface 35.

Preferably, there is a space 41, FIG. 4, between the upper surface of the heat block 32 and the opening or void in the heat shroud 40. Air in this additional space 41 also serves to insulate the standoff and mold machine from the heat created by the heat element 34 contained within the block 32.

Generally, the heat shroud 40 may comprise any metal alloy insulative to heat or which is a poor conductor of thermal energy. Metal alloys such as brass, copper, or composites thereof are all useful in forming the heat shroud 40. Also useful are aluminum and its oxides and alloys. Alloys and oxides of aluminum are preferred in the formation of the heat shroud 40 due to the ready commercial availability of these compounds. Aluminum alloys having an ASTM rating of 6061-T6 and 6063-T52 are generally preferred over elemental aluminum.

The assembly may additionally comprise a head standoff 50, FIG. 1, to position, aid in compression, and attach the head assembly to the block machine.

Generally, the head standoff 50 may comprise any number of designs to assist and serve this purpose. The head standoff may also be used to contain and store various wiring or other elements of the stripper shoe assembly which are not easily housed either on the stripper shoe 30, or the heat shroud 40.

The head standoff 50 may comprise any number of metal alloys which will withstand the environmental stresses of block molded processes. Preferred metals include steel alloys having a Rockwell "C"-Scale rating from about 60–65 which provide optimal wear resistance and the preferred rigidity.

Generally, metals found useful in the manufacture of the head standoff mold of the present invention include high grade carbon steel of 41-40 AISI (high nickel content, prehardened steel), carbon steel 40-50 (having added nickel) and the like. A preferred material includes carbon steel having a structural ASTM of A36. Generally, the head standoff 50 may be made through any number of mechanisms known to those of skill in the art.

Preferably, the standoff has an open design allowing for quick dissipation of heat. One preferred form of the head standoff 50 can be seen in FIGS. 1 and 2. In this embodiment the standoff has holes 58 for receipt of the studs 36A–36D stemming from the stripper shoe plate 30. Opening 58 allows for the further stringing of wiring 70 stemming from the heat elements 34. The standoff 50 may be further attached to the block machine through openings 55 in the top plate 54 of the standoff 50.

Figure 2:
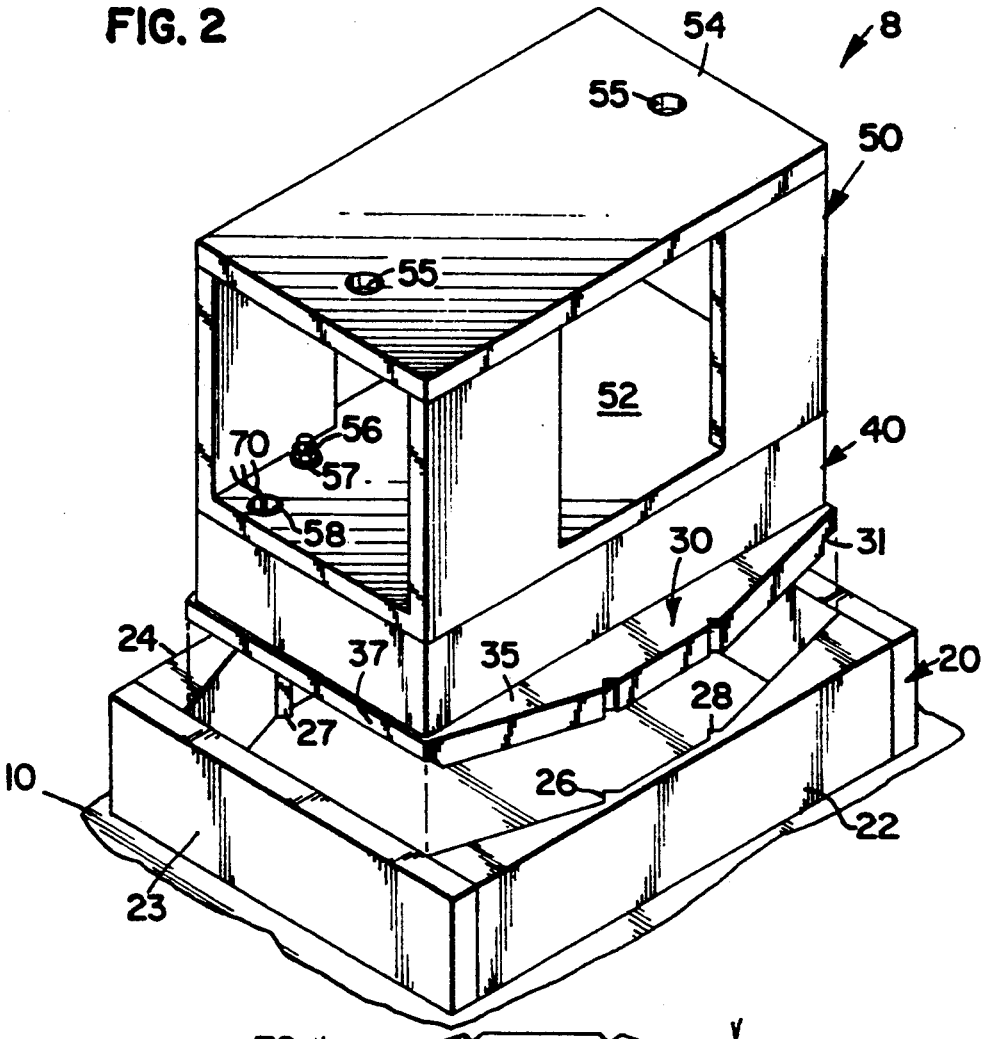
FIG. 2 comprises a perspective view of the heated stripper shoe/mold assembly depicted in FIG. 1.
Figure 5:
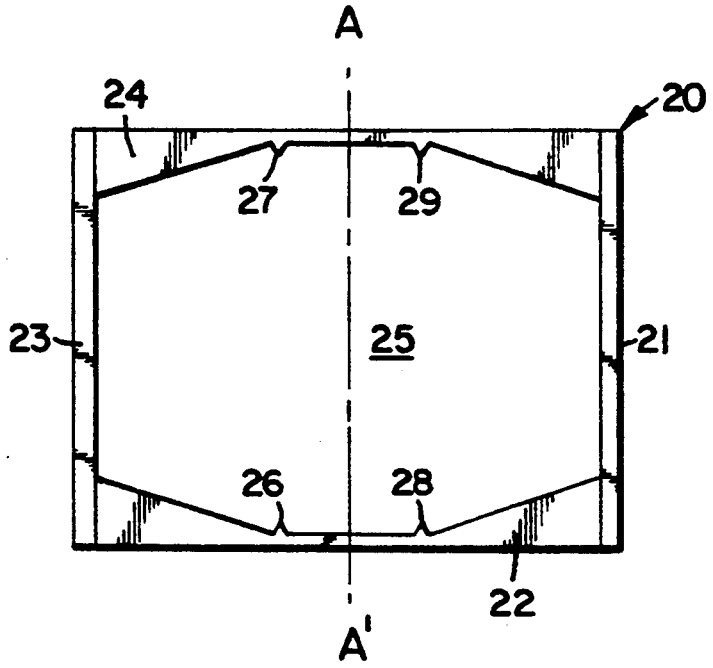
FIG. 5 is a top plan view of the mold depicted in FIG. 1.

As can be seen in FIGS. 1, 2 and 5, the invention may also comprise a mold 20. The mold generally functions to facilitate the formation of the blocks. Accordingly, the mold may comprise any material which will withstand the pressure to be applied to the block filled by the head. Preferably, metal such as steel alloys having a Rockwell "C"-Scale rating from about 60–65 which provide optimal wear resistance and the preferred rigidity.

Generally, other metals found useful in the manufacture of the mold of the present invention include high grade carbon steel of 41-40 AISI (high nickel content, prehardened steel), carbon steel 40-50 (having added nickel) and the like. A preferred material includes carbon steel having a structural ASTM of A36.

Mold 20 useful in the invention may take any number of shapes depending on the shape of the block to be formed and be made by any number of means known to those of skill in the art. Generally, the mold is produced by cutting the steel stock, patterning the cut steel, providing an initial weld to the pattern mold pieces and heat treating the mold. Heat treating generally may take place at temperatures ranging from about 1000° F. to about 1400° F. from 4 to 10 hours depending on the ability of the steel to withstand processing and not distort or warp. After heat treating, final welds are then applied to the pieces of the mold.

Turning to the individual elements of the mold, the mold walls generally function according to their form by withstanding the pressure created by the press. Further, the walls measure the height and the depth of resulting blocks. The mold walls must be made of a thickness which will accommodate the processing parameters of the block formation given a specific mold composition. Preferably, the mold walls range in thickness from about $\frac{3}{8}$ inch to about 1 inch, preferably from about $\frac{1}{2}$ inch to about $\frac{3}{4}$ inch.

In one preferred embodiment of the invention, FIGS. 1, 2 and 5 the mold may be fitted to form two blocks comprising four walls and an open central cavity 25, FIG. 5. The four walls are generally a front wall 21, a back or rear wall 3, and first and second opposing sidewalls, 22 and 24. Flanges such as 26–29 FIG. 5, may be formed on the interior sides of the mold walls to form ornamental features in the blocks or assist in forming splitting points for blocks that are formed in tandem or "siamese".

BLOCK MOLDING

In operation, the assembly 8 is generally positioned in the block molding machine atop of a removable or slidable pallet 10, FIGS. 1 and 2. The mold 20 is then loaded with block mix or fill. As configured in FIGS. 2 and 5, the mold 20 is set to form two blocks simultaneously in a "siamese" pattern. Once formed and cured, these blocks may be split along an edge created by flanges which may be positioned on the interior of sidewalls 22 and 24 generally along axis A'–A, FIG. 5. Prior to compression, the upper surface of the mold is vibrated to settle the fill and scraped or raked with the feed box drawer (not shown) to remove any excess fill. The mold is then subjected to compression directly by the stripper shoe 30 through head assembly 8.

Figure 6:
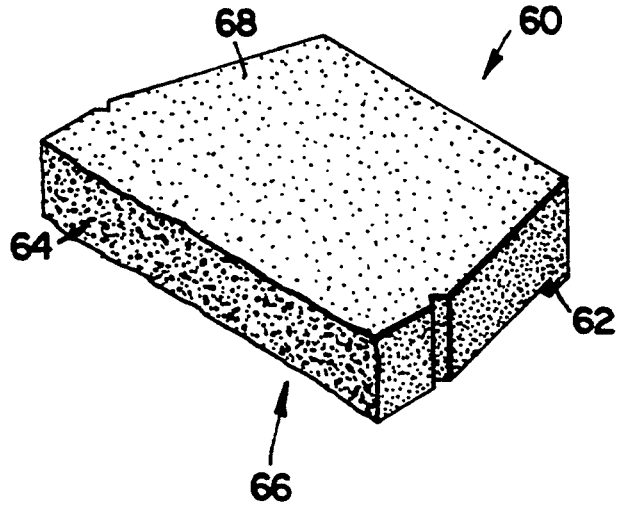
FIG. 6 is a perspective view of a concrete masonry block made in accordance with the embodiment of the claimed invention shown in FIG. 1.

Upon compression, the stripper shoe 30 forces block fill towards either end of the mold into the stripper shoe indentation 31 to create a flange 62 in the formed block 60, FIG. 6. This flange may range in size for example from about $\frac{3}{8}''$ to 2", preferably about $\frac{2}{3}''$ to $1\frac{1}{2}''$, and most preferably about 2/4" to $1\frac{1}{4}''$.

In accordance with the invention, this indentation 31 is heated by element 34 contained in the heat block 32 so that flanges of minimal size and varying shape may be formed without the build up of fill on the stripper shoe 30 at indentation 31. By doing so, the assembly may be used in the automatic manufacture of blocks by machine.

Blocks may be designed around any number of different physical properties in accordance with ASTM Standards depending upon the ultimate application for the block. For example, the fill may comprise from 75 to 95% aggregate being sand and gravel in varying ratios depending upon the physical characteristics which the finished block is intended to exhibit. The fill generally also comprises some type of cement at a concentration ranging from 4% to 10%. Other constituents may then be added to the fill at various trace levels in order to provide blocks having the intended physical characteristics.

Generally, once determined the fill constituents may be mixed by combining the aggregate, the sand and rock in the mixer followed by the cement. After one to two and one-half minutes, any plasticizers that will be used are added. Water is then introduced into the fill in pulses over a one to two minute period. The concentration of water in the mix may be monitored electrically by noting the electrical resistance of the mix at various times during the process. While the amount of water may vary from one fill formulation to another fill formulation, it generally ranges from about 1% to about 6%.

Once the mold has been filled, leveled by means such as a feed box drawer, and agitated, a compression mechanism such as a head carrying the inventive assembly converges on the exposed surface of the fill. The stripper shoe assembly 30 acts to compress the fill within the mold for a period of time sufficient to form a solid contiguous product. Generally, the compression time may be anywhere from 0.5 to 4 seconds and more preferably about 1.5 to 2 seconds. The compression pressure applied to the head ranges from about 1000 to about 8000 psi and preferably is about 4000 psi.

Once the compression period is over, the stripper shoe 30 in combination with the underlying pallet 10 acts to strip the blocks 60 from the mold 20. At this point in time the blocks are formed. Any block machine known to those of skill in the art may be used in accordance with the invention. One machine which has been found useful in the formation of blocks is a Besser V-3/12 block machine.

Generally, during or prior to compression the mold may be vibrated. The fill is transported from the mixer to a hopper which then fills the mold 20. The mold is then agitated for up to 2 to 3 seconds, the time necessary to ensure he fill has uniformly spread throughout the mold. The blocks are then formed by compressive action by the compressive action the head. Additionally, this vibrating may occur in concert with the compressive action of the head onto the fill in the mold. At this time, the mold will be vibrated for the time in which the head is compressed onto the fill.

Once the blocks are formed, they may be cured through any means known to those with skill in the art. Curing mechanisms such as simple air curing, autoclaving, steam curing or mist curing, are all useful methods of curing the block of the present invention. Air curing simply entails placing the blocks in an environment where they will be cured by open air over time. Autoclaving entails placing the blocks in a pressurized chamber at an elevated temperature for a certain period of time. The pressure in the chamber is then increased by creating a steady mist in the chamber. After curing is complete, the pressure is released from the chamber which in turns draws the moisture from the blocks.

Another means for curing blocks is by steam. The chamber temperature is slowly increased over two to three hours and then stabilized during the fourth hour. The steam is gradually shut down and the blocks are held at the eventual temperature, generally around 120°–200° F. for two to three hours. The heat is then turned off and the blocks are allowed to cool. In all instances, the blocks are generally allowed to sit for 12 to 24 hours before being stacked or stored. Critical to curing operations is a slow increase in temperature. If the temperature is increased too quickly, the blocks may "case-harden". Case hardening occurs when the outer shell of the block hardens and cures while the inner region of the block remains uncured and moist. While any of these curing mechanisms will work, the preferred mechanism is autoclaving.

Once cured the blocks may be split if they have been cast "siamese" or in pairs. Splitting means which may be used in the invention include manual chisel and hammer as well as machines known to those with skill in the art. Splitting economizes the production of blocks of the present invention by allowing the casting of more than one block at any given time.

In one preferred embodiment of the invention, a block 60 such as that shown in FIG. 6 is cast in pairs, joined at surface 64. The block is formed top side 68 down with flange 62 directed upwards and positioned at either end of the mold 20 at sides 21 and 23, see FIG. 5. When cast in pairs, the blocks 60 may be cast to have indentations or groove created by flanges 26–29 on their side surfaces between the two blocks. Flanges may also be positioned on the interior of the mold side walls to provide a natural weak point or fault which facilitates the splitting action when positioned along axis A'–A. The blocks may be split in a manner which provides a front surface 64 which is smooth or coarse, single faceted or multifaceted, as well as planar or curved. Preferably, splitting will be completed by an automatic hydraulic splitter. When split, the blocks may be cubed and stored.

The above discussion, examples and embodiments illustrate our current understanding of the invention. However, since many variations of the invention can be made without departing from the spirit and scope of the invention, the invention resides wholly in the claims hereafter appended.

I claim as my invention:

1. A heated stripper shoe assembly comprising means for forming structural features on composite masonry blocks, said forming means comprising:

(a) a stripper shoe plate having a top side and a bottom side, said stripper shoe plate bottom side comprising at least one indentation;

(b) means for applying heat to selected areas of the plate, said heating applying means comprising a heating element affixed to the top side of said plate, and (c) means for fastening said heating element to said stripper shoe plate top side, said fastening means positioned on said stripper shoe plate top side adjacent the indentation in said plate bottom side, said heating element positioned within said fastening means.

2. The assembly of claim 1 wherein said stripper shoe plate comprises at least four edges, and said stripper shoe plate indentation comprises a depression running the length of at least one edge of the shoe plate, and said heating element is positioned on the top side of said stripper shoe plate parallel to said indentation.

3. The assembly of claim 2 wherein said fastening means comprises a hollow rectangular block having a top side and a bottom side, and said hollow rectangular block is positioned parallel to said indentation.

4. The assembly of claim 3 wherein said block bottom side is open and said heating element is in contact with said stripper shoe plate top side.

5. The assembly of claim 3 wherein said heating element comprises an electrical resistance element removably inserted into said hollow rectangular block.

6. The assembly of claim 3 additionally comprising a heat shroud, said heat shroud positioned on said heated stripper shoe plate top side, said shroud having an indentation for enclosing said hollow rectangular block.

7. The assembly of claim 3 wherein said hollow rectangular block comprises a metal alloy.

8. The assembly of claim 7 wherein said hollow rectangular block metal alloy is selected from the group consisting of ASTM A36 steel, ASTM 41-40 carbon steel, and mixtures thereof.

9. The assembly of claim 7 wherein said hollow rectangular block metal alloy comprises ASTM A36 steel.

10. The assembly of claim 6 wherein said heat shroud comprises a metal compound selected from the group consisting of copper, brass, elemental aluminum, an aluminum oxide, an aluminum alloy, and mixtures thereof.

11. The assembly of claim 10 wherein said heat shroud comprises elemental aluminum.

12. The assembly of claim 1 wherein said heated stripper shoe assembly additionally comprises a heat shroud and a standoff, said standoff affixed to said heat shroud and said heat shroud affixed to said heated stripper shoe plate top side.

13. A heated stripper shoe assembly for use in manufacture of concrete masonry block, said heated stripper shoe assembly comprising means for forming structural features on composite masonry block, said forming means comprising:

(a) a stripper shoe plate comprising a lower side, a top side and first, second, third and fourth edges, said stripper shoe plate having first and second indentations located adjacent and substantially parallel to respective first and second edges on the plate wherein said first edge is parallel to said second edge across the surface of said stripper shoe plate;

(b) at least two heat blocks, including a first heat block and a second heat block, said first heat block positioned on said stripper shoe plate top side parallel and adjacent to said first indentation, said second heat block positioned on said stripper shoe plate top side substantially parallel and adjacent to said second indentation, said first and second heat blocks each comprising a hollow rectangular block having a top side and a bottom side, said block bottom side having an opening;

(c) at least two heating elements, including a first heating element and a second heating element, said first and second heating elements each comprising a cylinder, said first element removably inserted within said first heat block, and said second element removably inserted into said second heat block wherein each of said heat block bottom side openings allows free transmission of heat to said stripper shoe plate top side while insulating said stripper shoe assembly from heat generated by each of said heating elements;

(d) a heat shroud positioned over said heat blocks on the top side of said stripper shoe plate, said heat shroud comprising a lower side and an upper side, said heat shroud lower side having at least two heat shroud indentations for enclosing said first and second heat blocks, and (e) means for attaching said heated stripper shoe assembly to a block machine, said attachment means comprising a standoff attached to said heat shroud.

14. The assembly of claim 13 wherein said first and second heat blocks each comprise a metal alloy selected from the group consisting of ASTM A36 steel, ASTM 41-40 carbon steel, and mixtures thereof.

15. The assembly of claim 13 wherein said first and second heating elements each comprise an electrical resistance element having a wattage ranging from about 450 to about 1500 watts.

16. The assembly of claim 13 additionally comprising a mold comprising four sides designed and positioned in a manner to complement the outer perimeter of the stripper shoe plate, said mold comprising an open bottom and open top.

17. The assembly of claim 16 wherein said first and second heating elements comprise electrical resistance elements having a wattage ranging from about 450 to about 1500 watts.

18. The assembly of claim 16 wherein said heat shroud comprises an aluminum alloy and said standoff comprises steel.

* * * * *

US005249950B1

REEXAMINATION CERTIFICATE (3194th)

United States Patent [19] [11] B1 5,249,950

Woolford [45] Certificate Issued May 13, 1997

[54] HEATED STRIPPER SHOE ASSEMBLY

[75] Inventor: Michael E. Woolford, Lake Elmo, Minn.

[73] Assignee: Anchor Wall Systems, Inc., Minneapolis, Minn.

Reexamination Request:
No. 90/004,058, Dec. 15, 1995

Reexamination Certificate for:

| | |
|---|---|
| Patent No.: | **5,249,950** |
| Issued: | **Oct. 5, 1993** |
| Appl. No.: | **828,031** |
| Filed: | **Jan. 30, 1992** |

[51] Int. Cl.[6] ..... B28B 13/06

[52] U.S. Cl. ..... 425/412; 100/218; 425/413; 425/422; 425/443; 425/444

[58] Field of Search ..... 249/66.1, 78, 74, 249/136; 425/253, 255, 407, 412, 413, 422, 436 R, 444, 443, 452, DIG. 13; 100/218, 93 R, 93 P

[56] References Cited

U.S. PATENT DOCUMENTS

| | | | |
|---|---|---|---|
| 831,077 | 9/1906 | Johnson | 249/137 |
| 1,557,946 | 10/1925 | Smith | 249/144 |
| 1,751,028 | 3/1930 | Caswell et al. | 425/255 |
| 3,185,432 | 5/1965 | Hager, Jr. | 425/DIG. 13 |
| 3,386,503 | 6/1968 | Corning et al. | 249/78 |
| 3,659,077 | 4/1972 | Olson | 219/213 |
| 4,238,105 | 12/1980 | West | 249/78 |
| 4,659,304 | 4/1987 | Day | 425/406 |
| 4,721,847 | 1/1988 | Leverenz | 219/421 |
| 4,784,821 | 11/1988 | Leopold | 264/510 |
| 5,017,049 | 5/1991 | Sievert | 405/284 |
| 5,062,610 | 11/1991 | Woolford et al. | 249/52 |
| 5,125,815 | 6/1992 | Kargarzadeh et al. | 425/112 |
| 5,158,132 | 10/1992 | Guillemot | 425/DIG. 13 |
| 5,249,950 | 10/1993 | Woolford | 425/412 |
| 5,261,806 | 11/1993 | Pleasant | 425/144 |

FOREIGN PATENT DOCUMENTS

| | | |
|---|---|---|
| 2622227 | 12/1989 | France . |
| 24781 | 5/1993 | New Zealand . |
| 25131 | 6/1994 | New Zealand . |
| 25132 | 6/1994 | New Zealand . |
| 25133 | 6/1994 | New Zealand . |
| 27313 | 6/1996 | New Zealand . |
| 27314 | 6/1996 | New Zealand . |
| 27315 | 6/1996 | New Zealand . |
| 27316 | 6/1996 | New Zealand . |
| 27317 | 6/1996 | New Zealand . |
| 27318 | 6/1996 | New Zealand . |
| 27346 | 9/1996 | New Zealand . |
| 27675 | 9/1996 | New Zealand . |
| 27676 | 9/1996 | New Zealand . |
| 27677 | 9/1996 | New Zealand . |

OTHER PUBLICATIONS

Bulletin 7062 (Jul. 1, 1994).

*Besser Parts & Equipment* Besser Company, Alpena, Michigan (circa 1990).

*Technical Data for the Blockmaker,* including *High Quality Pavers From a Besser V3–12 Block Machine,* by Lucas E. Pfeiffenberger, pp. 33–34, Reprint from Besser Block, Fall 1982.

*A Review of Paver Production on Besser Block Machines,* by Lucas E. Pfeiffenberger, Manager, Research and Traning Center, pp. 35–37, Reprint from Besser Block, Fall 1984.

*Primary Examiner*—James P. Mackey

[57] ABSTRACT

The invention is a heated stripper shoe assembly for use in manufacture of concrete masonry blocks. The heated stripper shoe has a stripper shoe plate, at least one heat blocks and at leat one heat element fitted within the heat block. Optionally, the stripper shoe assembly may also include a heat shroud positioned over the heat block on the upper surface of the stripper shoe plate, a standoff attached to the heat shroud for affixing the assembly to a block machine, and a mold for use with the stripper shoe assembly. The invention also includes methods of using the assembly.

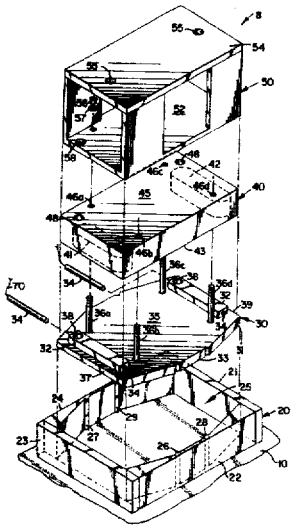

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–18 are cancelled.

* * * * *